United States Patent [19]

Hart

[11] 4,358,252

[45] Nov. 9, 1982

[54] DIAPHRAGM PUMPS

[75] Inventor: Bernard E. Hart, Salisbury, England

[73] Assignee: Harben System Limited, Salisbury, England

[21] Appl. No.: 162,597

[22] Filed: Jun. 24, 1980

[30] Foreign Application Priority Data

Jul. 18, 1979 [GB] United Kingdom ..... 7924979

[51] Int. Cl.[3] ..... F04B 43/10

[52] U.S. Cl. ..... 417/387; 417/394; 417/478

[58] Field of Search ..... 60/591, 544; 417/386, 417/387, 394, 478

[56] References Cited

U.S. PATENT DOCUMENTS

| | | | |
|---|---|---|---|
| 999,832 | 8/1911 | Milburn | 417/387 |
| 2,046,491 | 7/1936 | Scott | 417/387 |
| 2,303,597 | 12/1942 | Adelson | 417/386 X |
| 3,048,121 | 8/1962 | Sheesley | 417/478 X |
| 3,476,053 | 11/1969 | Czarnecki | 417/386 X |

FOREIGN PATENT DOCUMENTS

| | | |
|---|---|---|
| 1459471 | 12/1976 | United Kingdom . |
| 2003976 | 3/1979 | United Kingdom . |

*Primary Examiner*—Leonard E. Smith

*Attorney, Agent, or Firm*—Scrivener, Clarke, Scrivener and Johnson

[57] ABSTRACT

A diaphragm pump comprises a body defining a chamber in which a diaphragm is arranged to divide the chamber into a drive chamber and a pump chamber. The pump chamber has an inlet and an outlet for fluid to be pumped, each of the inlet and outlet being provided with a one-way valve. The drive chamber has an inlet for driving fluid and the inlet is provided with a valve which is open under normal operating conditions of the pump. The valve is arranged so that, if a high pressure persists in the pump chamber when the pressure in the drive chamber is relieved causing the diaphragm to expand, the diaphragm will contact the movable valve member of the valve to move it to a position closing the inlet opening so that the drive chamber is isolated from the drive fluid pressure variations while the abnormal pressure subsists in the pump chamber.

10 Claims, 4 Drawing Figures

DIAPHRAGM PUMPS

The present invention relates to improvements in and relating to diaphragm pumps.

A diaphragm pump, as is known, comprises a diaphragm separating a drive chamber to which a driving liquid is fed from a pump chamber for the fluid to be driven. The drive chamber is alternately pressurized and relieved of pressure to drive fluid from the pump chamber through an outlet provided with a one-way valve and to draw fluid in, or allow fluid to flow into, the pump chamber through an inlet provided with a one-way valve.

To provide a substantially constant pressure output of fluid, it is known to couple a plurality of such pumps together, the pumps being provided with common inlet and outlet ducts and being driven by common drive means but with the cycle of each pump being out of phase with the others. Such an arrangement however has the disadvantage that if an outlet valve of one of the pumps sticks open, the high pressure fluid in the common outlet duct flows back into the pump chamber and will eventually damage the diaphragm. The damage to the diaphragm which occurs mainly results from the fact that the diaphragm is pushed by the high pressure against the walls of the drive chamber and is extruded into openings and round sharp edges in or of those walls. One particular area in which extrusion can and does occur is around the inlet of driving fluid to the drive chamber.

It has been proposed in connection with a tubular diaphragm pump to cover this inlet with an apertured plate so as to reduce the area of the individual apertures through which the diaphragm could be extruded.

The damage to the diaphragm under such circumstances is increased by the fact that, while the pump chamber is filled with high pressure fluid, the drive chamber continues to be alternately filled with fluid under pressure and relieved of such pressure, so that the diaphragm is continually being re-applied to the wall of the drive chamber.

According to one aspect of the present invention there is provided a pump comprising a body provided with a chamber, a diaphragm in the chamber separating it into a drive chamber and a pump chamber, the pump chamber being provided with an inlet and an outlet for fluid to be pumped, each of the inlet and outlet being provided with a one-way valve, the drive chamber having an inlet for driving fluid which is under pressure and on which the pressure is relieved alternately associated with a valve for closing the inlet, the valve comprising a valve member arranged to be contacted by the diaphragm if a high pressure subsists in the pump chamber when the pressure in the drive chamber is relieved, to move the valve member to its closed position.

Preferably, the valve member will remain in its closed position so long as the high pressure subsists in the pump chamber but will return to its open position as soon as the high pressure is removed from the pump chamber.

Advantageously, when the valve member is moved to its closed position, driving fluid upstream thereof is diverted to reservoir or exhaust so that the valve member is not subject to driving fluid pressure. The valve member can thus be held in its closed position by the diaphragm, which remains at rest pressed by the high pressure in the pump chamber against the valve member in its closed position.

The valve member is preferably in the shape of a cup having a closed base which is presented to the diaphragm, and openings in its lateral wall through which driving fluid flows to the drive chamber when the valve member is in its open position. Advantageously the external surface of the closed base of the valve member is substantially flush with the walls of the drive chamber when the valve member is in its closed position.

The above described arrangement has particular application to a pump provided with a tubular diaphragm, the pump chamber being provided within the diaphragm and the drive chamber being defined between the diaphragm and the walls of the chamber in the pump body, but it is equally applicable to other diaphragm pumps.

An embodiment of the invention will now be described by way of example only with reference to the accompanying drawings, in which.

Figure 1:
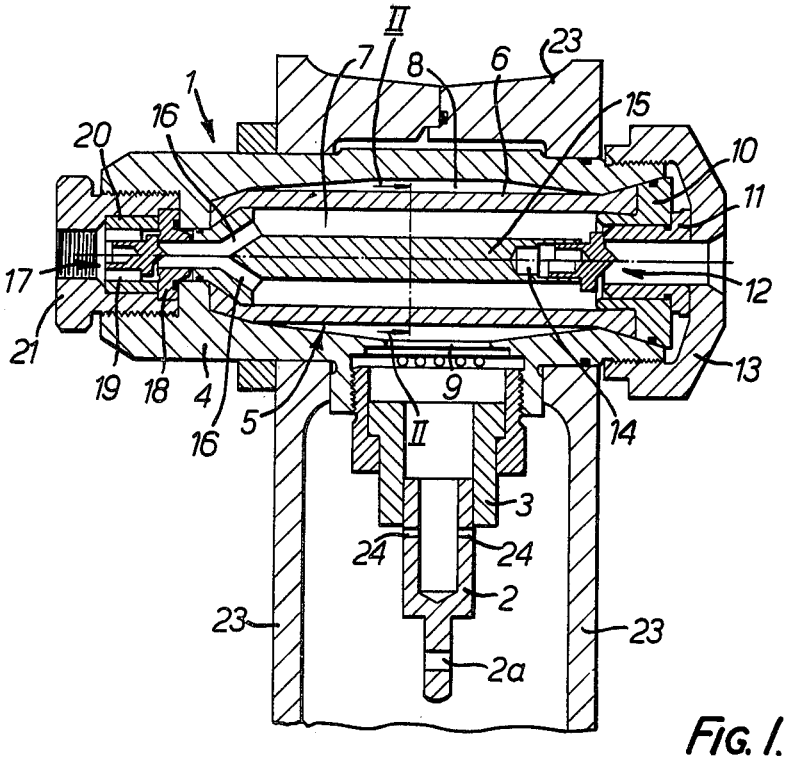
FIG. 1 is an axial section through an embodiment of a pump according to the present invention, the pump being one of a plurality of pumps of a pump assembly and being illustrated with part of the valve in the drive chamber inlet omitted.

The pump assembly, of which part is shown in FIG. 1, comprises a plurality of diaphragm pumps 1 driven by a common drive shaft and arranged so that the cycle of each pump differs in phase by a constant amount from the adjacent pump. To drive the pumps, the drive shaft may for example carry an eccentric, as described in British Pat. No. 1,403,528, the eccentric carrying equiangularly spaced lugs to each of which is coupled a piston 2 by a pin extending through an opening **2*a* in the piston. Each piston 2 is received in a cylinder 3 which extends radially from the body 4 of a pump 1**.

The body 4 is formed with a generally tubular chamber 5 in which a tubular diaphragm 6 is received. The diaphragm 6 divides the chamber 5 into a pump chamber 7 for fluid to be pumped and a drive chamber 8 for driving liquid, chamber 8 being connected to the cylinder 3 by an opening 9 in the wall of the body 4.

At the inlet end of the pump chamber 7, the diaphragm is held between the body 4 and a member 10, the member 10 being held in place by a member 11 which provides a seat for a one way inlet valve 12, and a locking member 13 which is threaded on to the body 4. The valve 12 is slidably received in a blind bore 14 in a mandrel 15 extending axially through the pump chamber.

At the outlet end of the pump chamber, the diaphragm 6 is held between the body 4 and the end of the mandrel 15 in which ducts 16 are provided for flow of fluid out of the pump chamber past a one-way valve 17 which is movable between a seat provided by member 18 and the axial ends of flanges 19 provided on an insert 20. The member 18 and insert 20 are held in place by locking member 21 which is threaded into the end of body 4.

Figure 2:
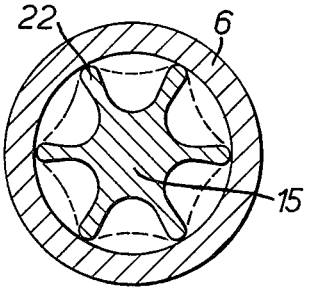
FIG. 2 is a section on the line II—II of FIG. 1.

As shown in FIG. 2, the mandrel is provided with a plurality of, as shown six, lobes 22 which contact the diaphragm 6 in its relaxed condition, as shown in FIGS. 1 and 2.

In the pump assembly, the plurality of pumps 1 are connected together by a casing 23 which is in two parts for assembly purposes. The casing is filled with driving liquid and the interior of each cylinder 3 is connected to the casing by passageways 24 in the respective piston, which passageways 24 are uncovered when the piston is in its retracted position as shown in FIG. 1.

In operation of the above described pump assembly, as the shaft rotates, each piston 2 is reciprocated in its cylinder 3. In the position shown in FIG. 1, the cylinder space is connected to the casing space which is at atmospheric pressure and the diaphragm 6 is in its relaxed condition. The piston 2 is moved from the position shown in FIG. 1 into the cylinder 3 to compress the driving liquid in the cylinder 3 and to place the diaphragm under pressure. This causes the diaphragm 6 to collapse about the mandrel 15 to drive liquid in the pump chamber 7 out of the chamber through the outlet valve 17. During the return movement of the piston 2 the diaphragm relaxes drawing liquid into the pump chamber 7 through the inlet valve 12. The pump shown in FIG. 1 is designed to operate with a very short cycle, for example at a rate of up to 1500 cycles per minute. For this reason, the diaphragm must be capable of returning to its relaxed condition very rapidly. Accordingly the diaphragm is highly resiliently flexible so that it stores energy as it is collapsed about the mandrel 15 and this energy is used to return the diaphragm to its relaxed condition.

Figure 3:
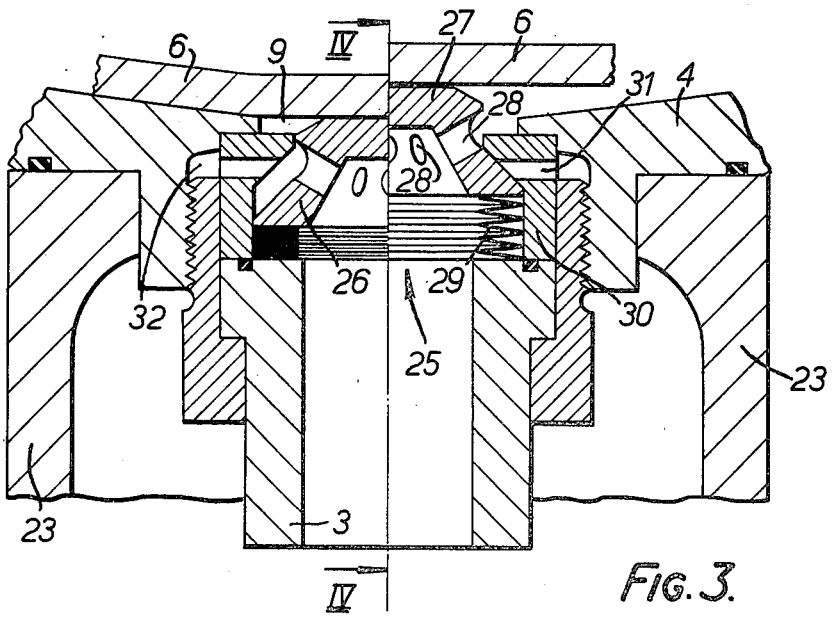
FIG. 3 is an enlarged section through the valve at the inlet of the drive chamber of FIG. 1.
Figure 4:
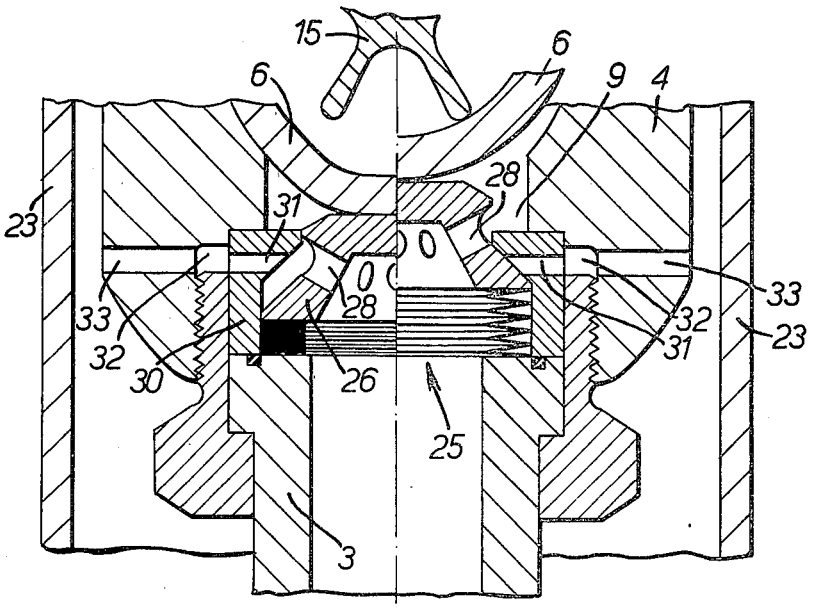
FIG. 4 is a section on the line IV—IV of FIG. 3.

As shown in FIGS. 3 and 4, the inlet opening 9 of the cylinder 3 into the drive chamber 8 is provided with a valve which is designed to protect the diaphragm 6 in the event that the outlet valve 17 of the pump 6 remains in its open position, for example because it has stuck open or has been damaged so that it cannot close, so that high pressure fluid flows backwards past the valve 17 into the pump chamber 7. Under such circumstances, the diaphragm 6 expands against the walls of the chamber 5 in the body 4. In the absence of any valve in opening 9, the diaphragm would then be subject to constant high pressure in chamber 7 which, when the piston is withdrawn from the cylinder and the passageways 24 are open, is not balanced by an equal high pressure in chamber 8. The diaphragm would therefore rupture across the opening 9.

As shown, the valve 25 comprises a valve member 26 which is movable between an open position shown on the right hand side of each of FIGS. 3 and 4 in which the cylinder 3 communicates with the drive chamber 8, and a closed position shown on the left hand side of each of FIGS. 3 and 4 in which communication between the cylinder 3 and the drive chamber 8 is closed.

The valve member 26 is generally cup-shaped having a closed base 27 and openings 28 provided in its lateral wall. The valve body is biased to its open position by springs 29, e.g. Belville washers, and cooperates with a valve body or member 30 received in the opening 9. The member 30 is provided with a plurality of radial passageways 31 which communicate with an annular chamber 32. Channel 32 is connected by passages 33 to the casing space.

In the open position of the valve member 26 the cylinder 3 is in communication with drive space 8 via the openings 28 and the lateral wall of the member 26 closes the passages 31. The valve member 26 is maintained in its open position for normal operating conditions by the springs 29 and is arranged so that it is not contacted by the diaphragm 6 under normal operating conditions. Should a high pressure be exerted within the pump chamber 7 when the pressure in the drive chamber has been relieved, the diaphragm 6 expands into contact with the valve member 26 and moves it to its closed position (as shown on the left hand side of FIGS. 3 and 4). In this position communication between the cylinder 3 and the drive chamber 8 is closed and the cylinder space 3 is placed in communication with the casing space (at atmospheric pressure) by communication between the openings 28, passages 31, channel 32 and passages 33. This relieves the pressure on the valve member 26 which will remain in its closed position unit the high pressure on the diaphragm 6 is relieved.

There is thus provided a valve at the inlet for the driving fluid to the drive chamber 8 which, under normal operating conditions of the pump, will remain open. If the diaphragm is subject to a high internal pressure when the pressure in the drive chamber has been relieved, the valve will be closed by the diaphragm and will remain closed until the pressure on the diaphragm is relieved. This has the advantage that, once the pump assembly is switched off and the diaphragm returns to its normal relaxed position, the valve will open under the bias of the springs 29. If the defect is not remedied before the pump is turned on again, as soon as the pump is turned on and high pressure is established in the common output ducts, the valve 25 will close. If however the defect in the outlet valve 17 has been remedied, the valve 25 will remain in its open condition and the pump will return to its normal operation.

As shown, the valve member 26 is arranged so that the surface of the base 27 of the valve member 26 presented to the diaphragm is generally planar and is generally flush with the surface of the walls of the drive chamber 8 when in its closed position.

While the invention has been described above in relation to a tubular diaphragm pump, it will be appreciated that it is applicable to other types of diaphragm pumps, e.g. such pumps with planar diaphragms.

What is claimed is:

1. A pump comprising a body defining a chamber, a diaphragm in said chamber separating said chamber into a drive chamber and a pump chamber, said pump chamber being provided with an inlet and an outlet for fluid to be pumped, one-way valve means mounted in each of said inlet and said outlet, said drive chamber having an inlet for driving fluid which is under pressure and on which the pressure is relieved alternately, said inlet being associated with a valve for closing said inlet, said valve including a valve member movable between an open position and a closed position closing said inlet, said valve member being in its open position under normal operating conditions of said pump and being arranged to be contacted by said diaphragm if a high pressure subsists in said pump chamber when the pressure in said drive chamber is relieved to move said valve member to its closed position, and means responsive to movement of said valve member to its closed position for supplying driving fluid to an exhaust outlet to relieve the pressure on said valve member for so long as said valve member remains in its closed position.

2. A pump as claimed in claim 1, wherein said valve member has the general shape of a cup with a closed base and a lateral wall, said closed base facing said diaphragm, openings being provided in said lateral wall through which drive fluid flows when said valve member is in its open position, and said valve including a valve body in which said valve member is slidably guided, said valve body having passage means communicating with said exhaust outlet, said valve member closing said passage means in its open position and opening said passage means in its closed position to supply driving fluid through said passage means to said exhaust outlet so long as said valve member remains in its closed position.

3. A pump comprising a body defining a chamber, a diaphragm in said chamber separating said chamber into a drive chamber and a pump chamber, said pump chamber being provided with an inlet and an outlet for fluid to be pumped, one-way valve means mounted in each of said inlet and said outlet, said drive chamber having an inlet for driving fluid which is under pressure and on which the pressure is relieved and a valve in said drive chamber inlet comprising a valve member movable between an open position and a closed position closing said inlet, said valve member being in its open position under normal operating conditions and being arranged to be contacted by said diaphragm if high pressure subsists in said pump chamber when the pressure in said drive chamber is relieved, so as to move said valve member to its closed position, wherein said valve member has the general shape of a cup with a closed base and a lateral wall, said closed base facing said diaphragm, opening means being provided in said lateral wall through which drive fluid will flow when said valve member is in its open position.

4. A pump as claimed in either claim 1 or claim 3, wherein said valve member is arranged to remain in its closed position so long as said high pressure subsists in said pump chamber and to return to its open position as soon as said high pressure is removed.

5. A pump as claimed in either claim 1 or claim 3, including means biassing said valve member to its open position where it remains during normal conditions of operation.

6. A pump as claimed in either claim 1 or claim 3, wherein said drive chamber inlet communicates with a cylinder, a piston being slidable in said cylinder to alternately cause pressurisation of the drive fluid and relieve the pressure thereof, and said valve is adapted to connect said cylinder to exhaust when said valve member thereof is in its closed position.

7. A pump as claimed in either claim 1 or claim 3, wherein said body defines a generally cylindrical chamber and said diaphragm is generally tubular, said pump chamber being defined within said diaphragm and said drive chamber being defined between said diaphragm and the wall of said chamber, and said drive chamber inlet is located in the cylindrical wall of said chamber intermediate the ends thereof.

8. A pump as claimed in claim 3, including means responsive to movement of said valve member to its closed position for supplying the driving fluid to an exhaust outlet to relieve the pressure on said valve member for so long as said valve member remains in its closed position.

9. A pump as claimed in either claim 1 or claim 8, wherein said valve includes a valve body in which said valve member is slidably guided, and valve body having passage means communicating with said exhaust outlet, said valve member closing said passage means in its open position and opening said passage means to said drive fluid when in its closed position.

10. A pump as claimed in claim 8, wherein said valve includes a valve body in which said valve member is slidably guided, said valve body having passage means communicating with said exhaust outlet, said valve member closing s said passage means in its open position and said opening means in said lateral wall of said valve member communicating with said passage means in said valve body when said valve member is in its closed position.

* * * * *